US010697252B2

(12) United States Patent
Burgos et al.

(10) Patent No.: US 10,697,252 B2
(45) Date of Patent: Jun. 30, 2020

(54) SURFACE CONTROLLED REVERSIBLE COILED TUBING VALVE ASSEMBLY

(71) Applicant: SCHLUMBERGER TECHNOLOGY CORPORATION, Sugar Land, TX (US)

(72) Inventors: Rex Burgos, Richmond, TX (US); Victor M. Bolze, Houston, TX (US); Wassim Kharrat, Sfax (TN); Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/133,371

(22) Filed: Sep. 17, 2018

(65) Prior Publication Data

US 2019/0017333 A1 Jan. 17, 2019

Related U.S. Application Data

(63) Continuation of application No. 13/645,963, filed on Oct. 5, 2012, now Pat. No. 10,077,618.

(51) Int. Cl.
*E21B 34/06* (2006.01)
*E21B 47/135* (2012.01)
(Continued)

(52) U.S. Cl.
CPC ..... *E21B 17/206* (2013.01); *E21B 23/002* (2013.01); *E21B 34/06* (2013.01);
(Continued)

(58) Field of Classification Search
CPC .. E21B 34/00; E21B 2034/002; E21B 34/066; E21B 34/16; E21B 2034/005
See application file for complete search history.

(56) References Cited

U.S. PATENT DOCUMENTS 2,558,427 A 6/1951 Fagan
2,651,027 A 9/1953 Vogel
(Continued)

FOREIGN PATENT DOCUMENTS

DE 2818656 A1 10/1979
DE 29816469 U1 12/1998
(Continued)

OTHER PUBLICATIONS

Wolfbeis et al., "Fiber Optic Fluorosensor for Oxygen and Carbon Dioxide", Anal. Chem., 1998, vol. 60, pp. 2028-2030.
(Continued)

*Primary Examiner* — Robert E Fuller
(74) *Attorney, Agent, or Firm* — Cathy Hewitt

(57) ABSTRACT

A valve assembly for reversibly governing fluid flow through coiled tubing equipment. Valves of the assembly may be directed by a telemetric line running from an oilfield surface. In this manner, valve adjustment and/or reversibility need not require removal of the assembly from the well in order to attain manual accessibility. Similarly, operation of the valves is not reliant on any particular flow rate or other application limiting means. As such, multiple fluid treatments at a variety of different downhole locations may take place with a reduced number of trips into the well and without compromise to flow rate parameters of the treatments.

14 Claims, 5 Drawing Sheets

(51) Int. Cl.

| | |
|---|---|
| ***E21B 17/20*** | (2006.01) |
| ***E21B 47/12*** | (2012.01) |
| ***E21B 23/12*** | (2006.01) |
| *E21B 34/00* | (2006.01) |

(52) U.S. Cl.

CPC ..... *E21B 34/066* (2013.01); *E21B 47/123* (2013.01); *E21B 2034/002* (2013.01); *E21B 2034/007* (2013.01)

(56) References Cited

U.S. PATENT DOCUMENTS

| | | | |
|---|---|---|---|
| 3,348,616 | A | 10/1967 | Zingg |
| 4,619,323 | A | 10/1986 | Gidley |
| 4,856,584 | A | 8/1989 | Seidner |
| 4,859,054 | A | 8/1989 | Harrison |
| 4,904,865 | A | 2/1990 | Meisner et al. |
| 4,926,940 | A | 5/1990 | Stromswold |
| 5,042,903 | A | 8/1991 | Jakubowski |
| 5,140,319 | A | 8/1992 | Riordan |
| 5,284,207 | A | 2/1994 | Bittleston et al. |
| 5,320,181 | A | 6/1994 | Lantier, Sr. et al. |
| 5,332,048 | A | 7/1994 | Underwood et al. |
| 5,419,395 | A | 5/1995 | Harvey et al. |
| 5,434,395 | A | 7/1995 | Storck et al. |
| 5,485,745 | A | 1/1996 | Rademaker et al. |
| 5,542,471 | A | 8/1996 | Dickinson |
| 5,573,225 | A | 11/1996 | Boyle et al. |
| 5,597,042 | A | 1/1997 | Tubel et al. |
| 5,810,080 | A | 9/1998 | Meynier |
| 5,898,517 | A | 4/1999 | Weis |
| 5,944,123 | A | 8/1999 | Johnson |
| 5,965,826 | A | 10/1999 | Von Bertrab |
| 5,992,250 | A | 11/1999 | Kluth et al. |
| 5,996,689 | A | 12/1999 | Head |
| 6,009,216 | A | 12/1999 | Pruett et al. |
| 6,062,311 | A | 5/2000 | Johnson et al. |
| 6,079,281 | A | 6/2000 | Oszajca et al. |
| 6,082,461 | A | 7/2000 | Newman et al. |
| 6,089,323 | A | 7/2000 | Newman et al. |
| 6,112,809 | A | 9/2000 | Angle |
| 6,157,893 | A | 12/2000 | Berger et al. |
| 6,173,771 | B1 | 1/2001 | Eslinger et al. |
| 6,173,795 | B1 | 1/2001 | McGarian et al. |
| 6,192,983 | B1 | 2/2001 | Neuroth et al. |
| 6,229,453 | B1 | 5/2001 | Gardner et al. |
| 6,241,031 | B1 | 6/2001 | Beaufort et al. |
| 6,247,536 | B1 | 6/2001 | Leismer et al. |
| 6,268,911 | B1 | 7/2001 | Tubel et al. |
| 6,273,189 | B1 | 8/2001 | Gissler et al. |
| 6,276,454 | B1 | 8/2001 | Fontana et al. |
| 6,281,489 | B1 | 8/2001 | Tubel et al. |
| 6,321,845 | B1 | 11/2001 | Deaton |
| 6,323,420 | B1 | 11/2001 | Head |
| 6,347,674 | B1 | 2/2002 | Bloom et al. |
| 6,349,768 | B1 | 2/2002 | Leising |
| 6,367,366 | B1 | 4/2002 | Bloom et al. |
| 6,392,151 | B1 | 5/2002 | Rafie et al. |
| 6,397,864 | B1 | 6/2002 | Johnson |
| 6,419,014 | B1 | 7/2002 | Meek et al. |
| 6,427,786 | B2 | 8/2002 | Beaufort et al. |
| 6,464,003 | B2 | 10/2002 | Bloom et al. |
| 6,467,557 | B1 | 10/2002 | Krueger et al. |
| 6,474,152 | B1 | 11/2002 | Mullins et al. |
| 6,478,097 | B2 | 11/2002 | Bloom et al. |
| 6,497,290 | B1 | 12/2002 | Misselbrook et al. |
| 6,519,568 | B1 | 2/2003 | Harvey et al. |
| 6,531,694 | B2 | 3/2003 | Tubel et al. |
| 6,534,449 | B1 | 3/2003 | Gilmour et al. |
| 6,581,455 | B1 | 6/2003 | Berger et al. |
| 6,629,568 | B2 | 10/2003 | Post et al. |
| 6,640,894 | B2 | 11/2003 | Bloom et al. |
| 6,644,402 | B1 | 11/2003 | Sharma et al. |
| 6,655,461 | B2 | 12/2003 | Eslinger et al. |
| 6,667,280 | B2 | 12/2003 | Chang et al. |
| 6,679,341 | B2 | 1/2004 | Bloom et al. |
| 6,691,587 | B1 | 2/2004 | King |
| 6,715,559 | B2 | 4/2004 | Bloom et al. |
| 6,745,854 | B2 | 6/2004 | Bloom et al. |
| 6,789,621 | B2 | 9/2004 | Wetzel et al. |
| 6,817,410 | B2 | 11/2004 | Wetzel et al. |
| 6,834,722 | B2 | 12/2004 | Vacik et al. |
| 6,868,906 | B1 | 3/2005 | Vail, III et al. |
| 6,889,771 | B1 | 5/2005 | Leising et al. |
| 6,935,423 | B2 | 8/2005 | Kusmer |
| 6,938,708 | B2 | 9/2005 | Bloom et al. |
| 7,048,047 | B2 | 5/2006 | Bloom et al. |
| 7,055,604 | B2 | 6/2006 | Jee et al. |
| 7,073,582 | B2 | 7/2006 | Connell et al. |
| 7,077,200 | B1 | 7/2006 | Adnan et al. |
| 7,080,700 | B2 | 7/2006 | Bloom et al. |
| 7,080,701 | B2 | 7/2006 | Bloom et al. |
| 7,121,364 | B2 | 10/2006 | Mock et al. |
| 7,124,819 | B2 | 10/2006 | Ciglenec et al. |
| 7,140,435 | B2 | 11/2006 | Defretin et al. |
| 7,140,437 | B2 | 11/2006 | McMechan et al. |
| 7,152,685 | B2 | 12/2006 | Adnan et al. |
| 7,174,974 | B2 | 2/2007 | Bloom et al. |
| 7,182,134 | B2 | 2/2007 | Wetzel et al. |
| 7,207,216 | B2 | 4/2007 | Meister et al. |
| 7,308,941 | B2 | 12/2007 | Rolovic et al. |
| 7,311,153 | B2 | 12/2007 | McKee et al. |
| 7,420,475 | B2 | 9/2008 | Adnan et al. |
| 7,515,774 | B2 | 4/2009 | Vannuffelen et al. |
| 7,565,834 | B2 | 7/2009 | Adnan et al. |
| 7,597,142 | B2 | 10/2009 | Hartog et al. |
| 7,614,452 | B2 | 11/2009 | Kenison et al. |
| 7,617,873 | B2 | 11/2009 | Lovell et al. |
| 7,654,318 | B2 | 2/2010 | Cooper et al. |
| 7,757,755 | B2 | 7/2010 | Kenison et al. |
| 7,793,732 | B2 | 9/2010 | Xu et al. |
| 7,827,859 | B2 | 11/2010 | Pipchuk et al. |
| 7,841,412 | B2 | 11/2010 | Jasser et al. |
| 7,929,812 | B2 | 4/2011 | Vannuffelen et al. |
| 8,230,915 | B2 | 7/2012 | Weng |
| 8,733,438 | B2 | 5/2014 | Kenison et al. |
| 8,770,303 | B2 | 7/2014 | Aguirre et al. |
| 8,844,653 | B2 | 9/2014 | deBoer |
| 10,385,680 | B2 | 8/2019 | Livescu et al. |
| 2001/0050172 | A1 | 12/2001 | Tolman et al. |
| 2002/0007945 | A1 | 1/2002 | Neuroth et al. |
| 2002/0007948 | A1 | 1/2002 | Bayne et al. |
| 2002/0007971 | A1 | 1/2002 | Beaufort et al. |
| 2002/0017386 | A1 | 2/2002 | Ringgenberg et al. |
| 2002/0029908 | A1 | 3/2002 | Bloom et al. |
| 2002/0104686 | A1 | 8/2002 | Bloom et al. |
| 2002/0125008 | A1 | 9/2002 | Wetzel et al. |
| 2003/0075361 | A1 | 4/2003 | Terry et al. |
| 2003/0116356 | A1 | 6/2003 | Bloom et al. |
| 2003/0121703 | A1 | 7/2003 | Bloom et al. |
| 2003/0155156 | A1* | 8/2003 | Livingstone ..... E21B 17/203 175/57 |
| 2003/0188875 | A1 | 10/2003 | Bloom et al. |
| 2004/0020653 | A1 | 2/2004 | Smith |
| 2004/0040707 | A1 | 3/2004 | Dusterhoft et al. |
| 2004/0045705 | A1 | 3/2004 | Gardner et al. |
| 2004/0067002 | A1 | 4/2004 | Berg et al. |
| 2004/0084190 | A1 | 5/2004 | Hill et al. |
| 2004/0104052 | A1 | 6/2004 | Livingstone |
| 2004/0129418 | A1 | 7/2004 | Jee et al. |
| 2004/0245018 | A1 | 12/2004 | Bloom et al. |
| 2005/0016730 | A1 | 1/2005 | McMechan et al. |
| 2005/0072577 | A1 | 4/2005 | Freeman |
| 2005/0082055 | A1 | 4/2005 | Bloom et al. |
| 2005/0126777 | A1 | 6/2005 | Rolovic et al. |
| 2005/0145415 | A1 | 7/2005 | Doering et al. |
| 2005/0236161 | A1 | 10/2005 | Gay et al. |
| 2005/0247488 | A1 | 11/2005 | Mock et al. |
| 2005/0252686 | A1 | 11/2005 | Bloom et al. |
| 2005/0263281 | A1 | 12/2005 | Lovell et al. |
| 2006/0044156 | A1 | 3/2006 | Adnan et al. |
| 2006/0102347 | A1 | 5/2006 | Smith |
| 2006/0152383 | A1 | 7/2006 | Yamate et al. |
| 2006/0157239 | A1 | 7/2006 | Ramos et al. |

(56) References Cited

U.S. PATENT DOCUMENTS

| | | | |
|---|---|---|---|
| 2006/0196694 | A1 | 9/2006 | Bloom et al. |
| 2006/0196696 | A1 | 9/2006 | Bloom et al. |
| 2007/0126594 | A1 | 6/2007 | Atkinson et al. |
| 2007/0137860 | A1 | 6/2007 | Lovell et al. |
| 2007/0215345 | A1 | 9/2007 | Lafferty et al. |
| 2007/0227741 | A1 | 10/2007 | Lovell et al. |
| 2008/0041594 | A1 | 2/2008 | Boles et al. |
| 2008/0053658 | A1 | 3/2008 | Wesson et al. |
| 2008/0066962 | A1 | 3/2008 | Rolovic et al. |
| 2008/0066963 | A1 | 3/2008 | Sheiretov et al. |
| 2008/0073077 | A1 | 3/2008 | Tunc et al. |
| 2008/0134774 | A1 | 6/2008 | Oddie |
| 2008/0142212 | A1 | 6/2008 | Hartog et al. |
| 2008/0210427 | A1 | 9/2008 | Ziauddin et al. |
| 2008/0236836 | A1 | 10/2008 | Weng |
| 2008/0308272 | A1 | 12/2008 | Thomeer et al. |
| 2009/0025923 | A1 | 1/2009 | Patel et al. |
| 2009/0084536 | A1 | 4/2009 | Kenison et al. |
| 2009/0151936 | A1 | 6/2009 | Greenaway |
| 2009/0301713 | A1 | 12/2009 | Xu et al. |
| 2010/0018703 | A1 | 1/2010 | Lovell et al. |
| 2010/0051289 | A1 | 3/2010 | Constantine et al. |
| 2010/0084132 | A1* | 4/2010 | Noya ..... E21B 17/206 166/254.2 |
| 2011/0155379 | A1 | 6/2011 | Bailey et al. |
| 2011/0308860 | A1 | 12/2011 | deBoer |
| 2017/0152738 | A1 | 6/2017 | Berzanskis et al. |

FOREIGN PATENT DOCUMENTS

| | | | |
|---|---|---|---|
| EP | 0203249 | A2 | 12/1986 |
| EP | 0853249 | A1 | 7/1998 |
| EP | 0911483 | B1 | 8/2006 |
| GB | 2177231 | A | 1/1987 |
| GB | 2275953 | A | 9/1994 |
| GB | 2299868 | A | 10/1996 |
| GB | 2346908 | A | 8/2000 |
| GB | 2362405 | A | 11/2001 |
| GB | 2378468 | A | 2/2003 |
| GB | 2378469 | A | 2/2003 |
| GB | 2413816 | A | 11/2005 |
| GB | 2434819 | A | 8/2007 |
| SU | 1236098 | A1 | 6/1986 |
| WO | 9521987 | A1 | 8/1995 |
| WO | 9708418 | A1 | 3/1997 |
| WO | 0036266 | A1 | 6/2000 |
| WO | 0046481 | A2 | 8/2000 |
| WO | 0109478 | A1 | 2/2001 |
| WO | 0244509 | A2 | 6/2002 |
| WO | 2004072433 | A2 | 8/2004 |
| WO | 2005116388 | A1 | 12/2005 |
| WO | 2008024859 | A1 | 2/2008 |
| WO | 2008081404 | A1 | 7/2008 |

OTHER PUBLICATIONS

Maher et al., "A Fiber Optic Chemical Sensor for Measurement of Groundwarter pH", The American Society for Testing and Materials, Sep. 1993, pp. 448-452, vol. 21, No. 5.

Esteban et al., "Measurement of the Degree of Salinity of Water With a Fiber-Optic Sensor", Sep. 1999, Applied Optics, vol. 38, Issue 25, pp. 5267-5271.

International Search Report issued in International Patent Appl. No. PCT/IB2005/051734 dated Aug. 5, 2005; 3 pages.

Written Opinion issued in International Patent Appl. No. PCT/IB2005/051734 dated Aug. 5, 2005; 5 pages.

Eslinger et al., "A Hybrid Milling/Jetting Tool—The Safe Solution to Scale Milling", SPE 60700, Society of Petroleum Engineers, Inc., Houston, Texas, Apr. 5-6, 2000, 6 pages.

Johnson et al., "An Abrasive Jetting Scale Removal System", SPE 46026, Society of Petroleum Engineers, Inc., Houston, Texas, Apr. 15-16, 1996, 6 pages.

* cited by examiner

SURFACE CONTROLLED REVERSIBLE COILED TUBING VALVE ASSEMBLY

CROSS REFERENCE TO RELATED APPLICATION(S)

The present application is a continuation-in-part claiming priority under 35 U.S.C. § 120 to U.S. application Ser. No. 12/575,024, entitled System and Methods Using Fiber Optics in Coiled Tubing, filed Oct. 7, 2009, and which is a Continuation of Ser. No. 11/135,314 of the same title, filed on May 23, 2005, both of which are incorporated herein by reference in their entireties along with the Provisional Parent of the same title under 35 U.S.C. § 119(e), App. Ser. No. 60/575,327, filed on May 28, 2004.

FIELD

Embodiments described relate to tools and techniques for delivering treatment fluids to downhole well locations. In particular, embodiments of tools and techniques are described for delivering treatment fluids to downhole locations of low pressure bottom hole wells. The tools and techniques are directed at achieving a degree of precision with respect to treatment fluid delivery to such downhole locations.

BACKGROUND

Exploring, drilling and completing hydrocarbon and other wells are generally complicated, time consuming, and ultimately very expensive endeavors. As a result, over the years, a tremendous amount of added emphasis has been placed on monitoring and maintaining wells throughout their productive lives. Well monitoring and maintenance may be directed at maximizing production as well as extending well life. In the case of well monitoring, logging and other applications may be utilized which provide temperature, pressure and other production related information. In the case of well maintenance, a host of interventional applications may come into play. For example, perforations may be induced in the wall of the well, regions of the well closed off, debris or tools and equipment removed that have become stuck downhole, etc. Additionally, in some cases, locations in the well may be enhanced, repaired or otherwise treated by the introduction of downhole treatment fluids such as those containing acid jetting constituents, flowback control fibers and others.

With respect to the delivery of downhole treatment fluid, several thousand feet of coiled tubing may be advanced through the well until a treatment location is reached. In many cases a variety of treatment locations may be present in the well, for example, where the well is of multilateral architecture. Regardless, the advancement of the coiled tubing to any of the treatment locations is achieved by appropriate positioning of a coiled tubing reel near the well, for example with a coiled tubing truck and delivery equipment. The coiled tubing may then be driven to the treatment location.

Once positioned for treatment, a valve assembly at the end of the coiled tubing may be opened and the appropriate treatment fluid delivered. For example, the coiled tubing may be employed to locate and advance to within a given lateral leg of the well for treatment therein. As such, a ball, dart, or other projectile may be dropped within the coiled tubing for ballistic actuation and opening of the valve at the end of the coiled tubing. Thus, the treatment fluid may be delivered to the desired location as indicated. So, by way of example, an acid jetting clean-out application may take place within the targeted location of the lateral leg.

Unfortunately, once a treatment application through a valve assembly is actuated as noted above, the entire coiled tubing has to be removed from the well to perform a subsequent treatment through the assembly. That is, as a practical matter, in order to re-close the valve until the next treatment location is reached for a subsequent application, the valve should be manually accessible. In other words, such treatments are generally 'single-shot' in nature. For example, once a ball is dropped to force open a sleeve or other port actuating feature, the port will remain open until the ball is manually removed and the sleeve re-closed.

As a result of having to manually access the valve assembly between downhole coiled tubing treatments, a tremendous amount of delay and expense are added to operations wherever multiple coiled tubing treatments are sought. This may be particularly the case where treatments within multilaterals are sought. For example, an acid jetting treatment directed at 3-4 different legs of a multilateral well may involve 6-8 different trips into and out of the well in order to service each leg. That is, a trip in, a valve actuation and clean-out, and a trip out for manual resetting of the valve for each treatment. Given the depths involved, this may add days of delay and tens if not hundreds of thousands of dollars in lost time before complete acid treatment and clean-out to each leg is achieved.

A variety of efforts have been undertaken to address the costly well trip redundancy involved in coiled tubing fluid treatments as noted above. For example, balls or other projectiles utilized for valve actuation may be constructed of degradable materials. Thus, in theory, the ball may serve to temporarily provide valve actuation, thereby obviating the need to remove the coiled tubing in order to reset or re-close the valve. Unfortunately, this involves reliance on a largely unpredictable and uncontrollable rate of degradation. As such, tight controls over the delivery of the treatment fluids or precisely when the coiled tubing might be moved to the next treatment location are foregone.

As an alternative to ball-drop type of actuations, a valve assembly may be utilized which is actuated at given predetermined flow rates. So, for example, when more than 1 barrel per minute (BPM) is driven through the coiled tubing, the valve may be opened. Of course, this narrows the range of flow rate which may be utilized for the given treatment application and reduces the number of flow rates left available for other applications. In a more specific example, this limits the range of flow available for acid jetting at the treatment location and also reduces flow options available for utilizing flow driven coiled tubing tools, as may be the case for milling, mud motors, or locating tools. Thus, as a practical matter, operators are generally left with the more viable but costly manual retrieval between each treatment.

SUMMARY

A reversible valve assembly is disclosed for coiled tubing deployment into a well from an oilfield surface. The assembly includes a valve disposed within a channel of the assembly for reversibly regulating flow therethrough. A communication mechanism, such as a fiber optic line may be included for governing the regulating of the flow. The valve itself may be of a sleeve, ball and/or adjustable orifice configuration. Further, the valve may be the first of multiple valves governing different passages. Once more, in one embodiment first and second valves may be configured to alternatingly open their respective passages based on input from the communication mechanism.

DETAILED DESCRIPTION

Embodiments are described with reference to certain downhole applications. For example, in the embodiments depicted herein, downhole cleanout and fiber delivery applications are depicted in detail via coiled tubing delivery. However, a variety of other application types may employ embodiments of a reversible coiled tubing valve assembly for a variety of different types of treatment fluids as described herein. Regardless, the valve assembly embodiments include the unique capacity to regulate fluid pressure and/or delivery for a given downhole application while also being adjustable or reversible for a subsequent application without the need for surface retrieval and manipulation.

Figure 1:
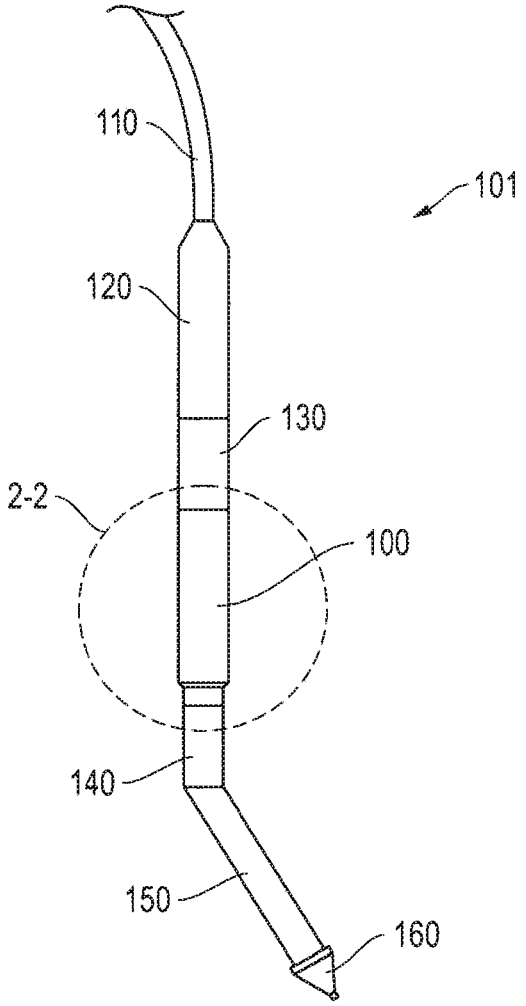
FIG. 1 is a front view of downhole coiled tubing equipment employing an embodiment of a surface controlled reversible coiled tubing valve assembly.
Figure 3:
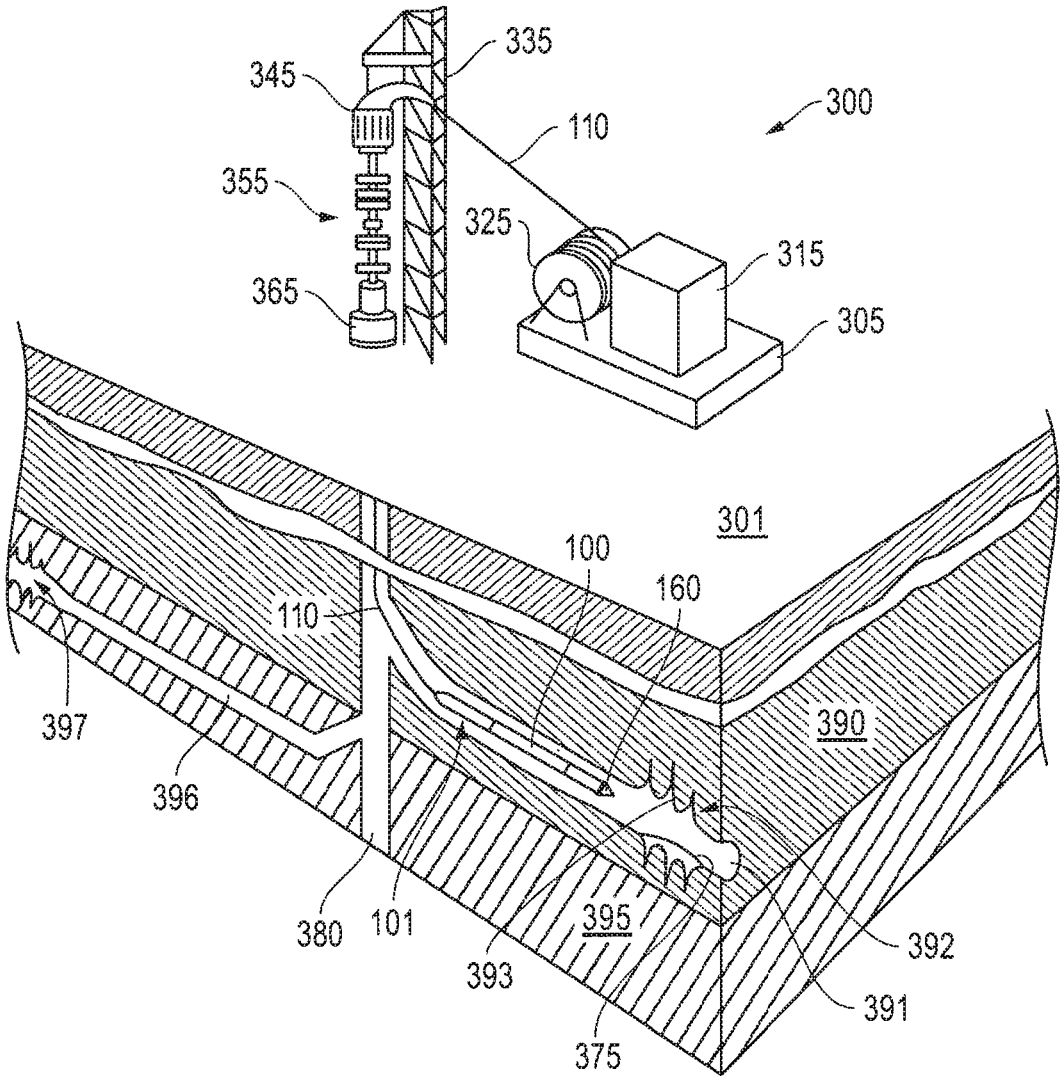
FIG. 3 is an overview depiction of an oilfield with a multilateral well accommodating the coiled tubing equipment and valve assembly of FIGS. 1 and 2.

Referring now to FIG. 1, with added reference to FIG. 3, a front view of downhole coiled tubing equipment 101 is depicted. The equipment 101 includes a reversible valve assembly 100 which, in conjunction with other downhole tools, may be deployed by coiled tubing 110 at an oilfield 301. Indeed, the assembly 100 and other tools of the equipment 101 may communicate with, or be controlled by, equipment located at the oilfield 301 as detailed further below. The valve assembly 100 in particular may be utilized in a reversible and/or adjustable manner. That is, it may be fully or partially opened or closed via telemetric communication with surface equipment.

A 'universal' valve assembly 100, so to speak, with reversibility, may be employed to reduce trips into and out of a well 380 for fluid based treatments as indicated above. This capacity also lends to easier reverse circulation, that is, flowing fluids into and out of the well 380. Further, this capacity also allows for utilizing the valve assembly 100 as a backpressure or check valve as needed. Once more, given that the valve assembly 100 operates independent of fluid flow, flow rates through the equipment 101 may be driven as high or as low as needed without being limited by the presence of the assembly 100.

Telemetry for such communications and/or control as noted above may be supplied through fiber optic components as detailed in either of application Ser. Nos. 12/575,024 or 11/135,314, both entitled System and Methods Using Fiber Optics in Coiled Tubing and incorporated herein by reference in their entireties. However, other forms of low profile coiled tubing compatible telemetry may also be employed. For example, encapsulated electrically conductive line of less than about 0.2 inches in outer diameter may be utilized to provide communications between the valve assembly 100 and surface equipment.

Regardless, the particular mode of telemetry, the power supply for valve assembly 100 maneuvers may be provided through a dedicated downhole source, which addresses any concerns over the inability to transport adequate power over a low profile electrically conductive line and/or fiber optic components. More specifically, in the embodiment shown, an electronics and power housing 120 is shown coupled to the coiled tubing 110. This housing 120 may accommodate a lithium ion battery or other suitable power source for the valve assembly 100 and any other lower power downhole tools. Electronics for certain downhole computations may also be found in the housing 120, along with any communicative interfacing between telemetry and downhole tools, as detailed further below.

The coiled tubing 110 of FIG. 1 is likely to be no more than about 2 inches in outer diameter. Yet, at the same time, hard wired telemetry may be disposed therethrough as indicated above. Thus, the fiber optic or low profile electrically conductive line options for telemetry are many. By the same token, the limited inner diameter of the coiled tubing 110 also places physical limitations on fluid flow options therethrough. That is to say, employing flow rate to actuate downhole tools as detailed further below will be limited, as a practical matter, to flow rates of between about ½ to 2 BPM. Therefore, utilizing structural low profile telemetry for communications with the valve assembly 100, as opposed to flow control techniques, frees up the limited range of available flow rates for use in operating other tools as detailed further below.

Continuing with reference to FIG. 1, the coiled tubing equipment 101 may be outfitted with a locator extension 140, arm 150 and regulator 130 for use in directing the equipment 101 to a lateral leg 391 of a well 380 as detailed below. As alluded to above, these tools 140, 150, 130 may be operate via flow control. More specifically, these tools 140, 150, 130 may cooperatively operate together as a pressure pulse locating/communication tool. Similarly, the equipment 101 is also outfitted with a flow operated jetting tool 160 for use in a cleanout application as also detailed below.

Figure 2:
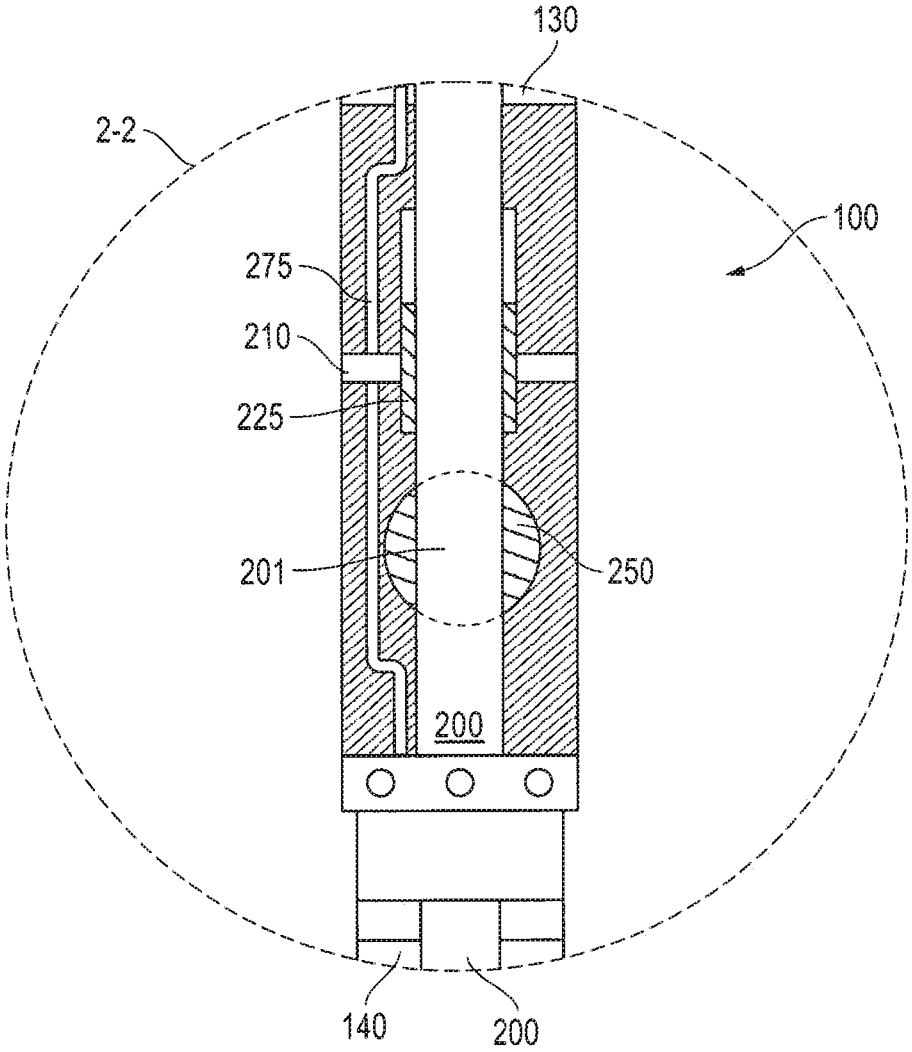
FIG. 2 is an enlarged cross-sectional view of the reversible coiled tubing valve assembly taken from 2-2 of FIG. 1.

Referring now to FIG. 2, an enlarged cross-sectional view of the valve assembly 100 taken from 2-2 of FIG. 1 is depicted. The assembly 100 includes a central channel 200. The channel 200 is defined in part by sleeve 225 and ball 250 valves. In the embodiment shown, these valves 225, 250 are oriented to allow and guide fluid flow through the assembly 100. More specifically, for the depicted embodiment, any fluid entering the channel 200 from a tool uphole of the assembly 100 (e.g. the noted regulator 130) is directly passed through to the tool downhole of the assembly 100 (e.g. the noted locator extension 140). With added reference to FIG. 3, a clean flow of fluid through the assembly 100 in this manner may take place as a matter of providing hydraulic support to the coiled tubing 110 as it is advanced through a well 380 in advance of any interventional applications.

However, depending an the application stage undertaken via the assembly, these valves 225, 250 may be in different positions. For example, as depicted in FIG. 4C, the sleeve valve 225 may be shifted open to expose side ports 210 for radial circulation. Similarly, the ball valve 250 may be oriented to a closed position, perhaps further encouraging such circulation, as also shown in FIG. 4C.

Continuing with reference to FIG. 2, with added reference to FIG. 3, the particular positioning of the valves 225, 250 may be determined by a conventional powered communication line 275. That is, with added reference to FIG. 1, the line 275 may run from the electronics and power housing 120. Thus, adequate power for actuating or manipulating the valve 225 or 250 through a solenoid, pump, motor, a piezo-electric stack, a magnetostrictive material, a shape memory material, or other suitable actuating element may be provided.

At the housing 120, the line 275 may also be provided with interfaced coupling to the above noted telemetry (of a fiber optic or low profile electrical line). Indeed, in this manner, real-time valve manipulations or adjustment may be directed from an oilfield surface 301, such as by a control unit 315. As a result, the entire coiled tubing equipment 101 may be left downhole during and between different fluid flow applications without the need for assembly 100 removal in order to manipulate or adjust valve positions.

In one embodiment, the assembly 100 may be equipped to provide valve operational feedback to surface over the noted telemetry. For example, the assembly 100 may be outfitted with a solenoid such as that noted above, which is also linked to the communication line 275 to provide pressure monitoring capacity, thereby indicative of valve function.

It is worth noting that each valve 225, 250 may be independently operated. So, for example, in contrast to FIG. 2 (or FIG. 4C) both valves 225, 250 may also be opened or closed at the same time. Further, a host of additional and/or different types of valves may be incorporated into the assembly 100. In one embodiment, for example, the ball valve 250 may be modified with a side outlet emerging from its central passage 201 and located at the position of the sleeve valve 225 of FIG. 2. Thus, the outlet may be aligned with one of the side ports 210 to allow simultaneous flow therethrough in addition to the central channel 200. Of course, with such a configuration, orientation of the central passage 201 with each port 210, and the outlet with the channel 200, may be utilized to restrict flow to the ports 210 alone.

With specific reference to FIG. 3, an overview of the noted oilfield 301 is depicted. In this view, the oilfield 301 is shown accommodating a multilateral well 380 which traverses various formation layers 390, 395. A different lateral leg 391, 396, each with its own production region 392, 397 is shown running through each layer 390, 395. These regions 392, 397 may include debris 375 for cleanout with a jetting tool 160 or otherwise necessitate fluid based intervention by the coiled tubing equipment 201. Nevertheless, due to the configuration of the valve assembly 100, such applications may take place sequentially as detailed herein without the requirement of removing the equipment 201 between applications.

Continuing with reference to FIG. 3, the coiled tubing equipment 101 may be deployed with the aid of a host of surface equipment 300 disposed at the oilfield 301. As shown, the coiled tubing 110 itself may be unwound from a reel 325 and forcibly advanced into the well 380 through a conventional gooseneck injector 345. The reel 325 itself may be positioned at the oilfield 301 atop a conventional skid 305 or perhaps by more mobile means such as a coiled tubing truck. Additionally, a control unit 315 may be provided to direct coiled tubing operations ranging from the noted deployment to valve assembly 100 adjustments and other downhole application maneuvers.

In the embodiment shown, the surface equipment 300 also includes a valve and pressure regulating assembly, often referred to as a 'Christmas Tree' 355, through which the coiled tubing 110 may controllably be run. A rig 335 for supportably aligning the injector 345 over the Christmas Tree 355 and well head 365 is also provided. Indeed, the rig 335 may accommodate a host of other tools depending on the nature of operations.

Figure 4A:
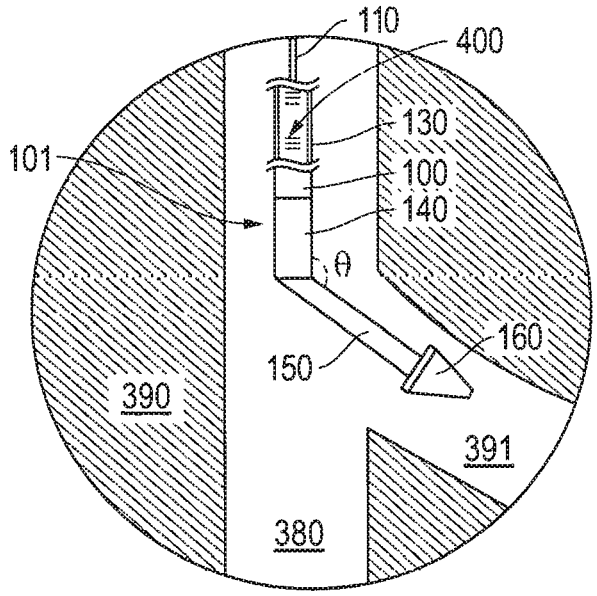
FIG. 4A is an enlarged view of a locator extension of the coiled tubing equipment signaling access of a leg of the multilateral well of FIG. 3.
Figure 4B:
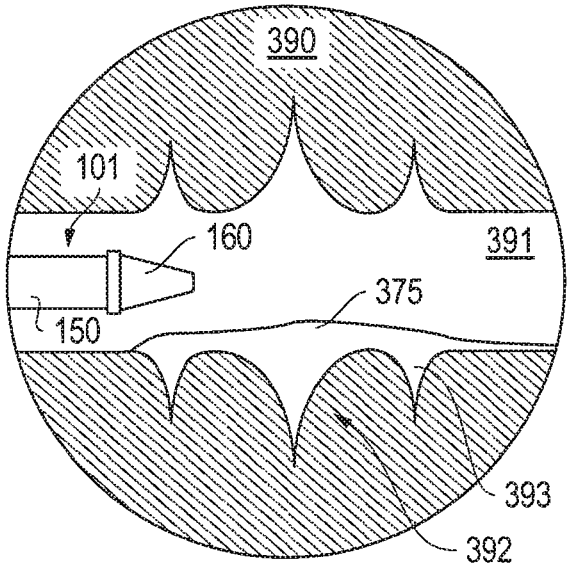
FIG. 4B is an enlarged view of a jetting tool of the coiled tubing equipment reaching a target location in the leg of FIG. 4A for cleanout.
Figure 4C:
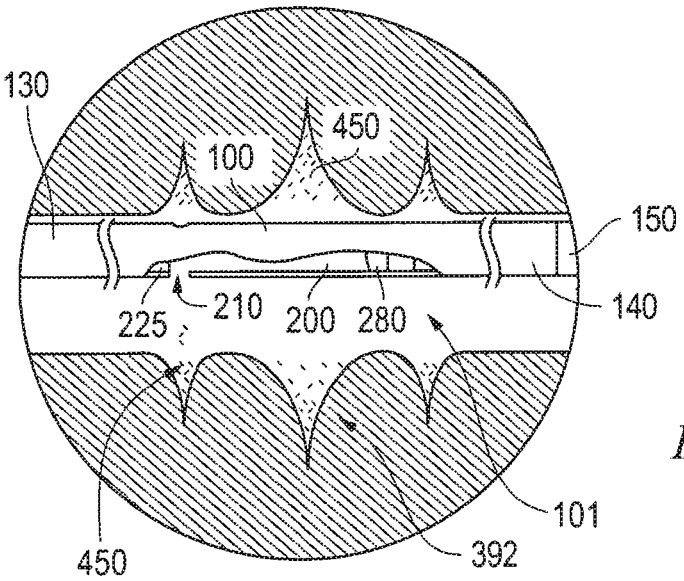
FIG. 4C is an enlarged sectional view of the valve assembly of the coiled tubing equipment adjusted for a fiber delivery application following the cleanout application of FIG. 4B.

Referring now to FIGS. 4A-4C, enlarged views of the coiled tubing equipment 101 as it reaches and performs treatments in a lateral leg 391 are shown. More specifically, FIG. 4A depicts a locator extension 140 and arm 150 acquiring access to the leg 391. Subsequently, FIGS. 4B and 4C respectively reveal fluid cleanout and fiber delivery applications at the production region 392 of the lateral leg 391.

With specific reference to FIG. 4A, the locator extension 140 and arm 150 may be employed to gain access to the lateral leg 391 and to signal that such access has been obtained. For example, in an embodiment similar to those detailed in application Ser. No. 12/135,682, Backpressure Valve for Wireless Communication (Xu et al.), the extension 140 and arm 150 may be drawn toward one another about a joint at an angle θ. In advance of reaching the leg 391, the size of this angle θ may be maintained at a minimum as determined by the diameter of the main bore of the well 380. However, once the jetting tool 160 and arm 150 gain access to the lateral leg 391, a reduction in the size of the angle θ may be allowed. As such, a conventional pressure pulse signal 400 may be generated for transmission through a regulator 130 and to surface as detailed in the '682 Application and elsewhere.

With knowledge of gained access to the lateral leg 391 provided to the operator, subsequent applications may be undertaken therein as detailed below. Additionally, it is worth noting that fluid flow through the coiled tubing 110, the regulator 130, the extension 140 and the arm 150 is unimpeded by the intervening presence of the valve assembly 100. That is, to the extent that such flow is needed to avoid collapse of the coiled tubing 110, to allow for adequate propagation of the pressure pulse signal 400, or for any other reason, the assembly 100 may be rendered inconsequential. As detailed above, this is due to the fact that any valves 225, 250 of the assembly 100 are operable independent of the flow through the equipment 101.

Continuing now with reference to FIG. 4B, an enlarged view of the noted jetting tool 160 of the coiled tubing equipment 101 is shown. More specifically, this tool 160 is depicted reaching a target location at the production region 392 of the leg 391 for cleanout. Indeed, as shown, debris 375 such as sand, scale or other buildup is depicted obstructing recovery from perforations 393 of the region 392.

With added reference to FIGS. 1 and 2, the ball valve 250 of the assembly 100 may be in an open position for a jetting application directed at the debris 375. More specifically, 1-2 BPM of an acid based cleanout fluid may be pumped through the coiled tubing 110 and central channel 200 to achieve cleanout via the jetting tool 160. Again, however, the ball valve 250 being in the open position for the cleanout application is achieved and/or maintained in a manner independent of the fluid flow employed for the cleanout. Rather, low profile telemetry, fiber optic or otherwise, renders operational control of the valve assembly 100 and the valve 250 of negligible consequence or impact on the fluid flow.

Referring now to FIG. 4C, with added reference to FIG. 2, an enlarged sectional view of the valve assembly 100 is shown. By way of contrast to the assembly 100 of FIG. 2, however, the valves 225, 250 are now adjusted for radial delivery of a fiber 450 following cleanout through the jetting tool 160 of FIG. 4B. Delivery of the fibers 450 through the comparatively larger radial ports 210 in this manner may help avoid clogging elsewhere (e.g., at the jetting tool 160). The fibers 450 themselves may be of glass, ceramic, metal or other conventional flowback discouraging material for disposal at the production region 392 to help promote later hydrocarbon recovery.

Regardless, in order to switch from the cleanout application of FIG. 4B to the fiber delivery of FIG. 4C, the acid flow may be terminated and the ball valve 250 rotated to close off the channel 200. As noted above, this is achieved without the need to remove the assembly 100 for manual manipulation at the oilfield surface 301 (see FIG. 3). A streamlined opening of the sleeve valve 225 to expose radial ports 210 may thus take place in conjunction with providing a fluid flow of a fiber mixture for the radial delivery of the fiber 450 as depicted. Once more, while the fluid flow is affected by the change in orientation of the valves 225, 250, the actual manner of changing of the orientation itself is of no particular consequence to the flow. That is, due to the telemetry provided, no particular flow modifications are needed in order to achieve the noted changes in valve orientation.

Figure 5:
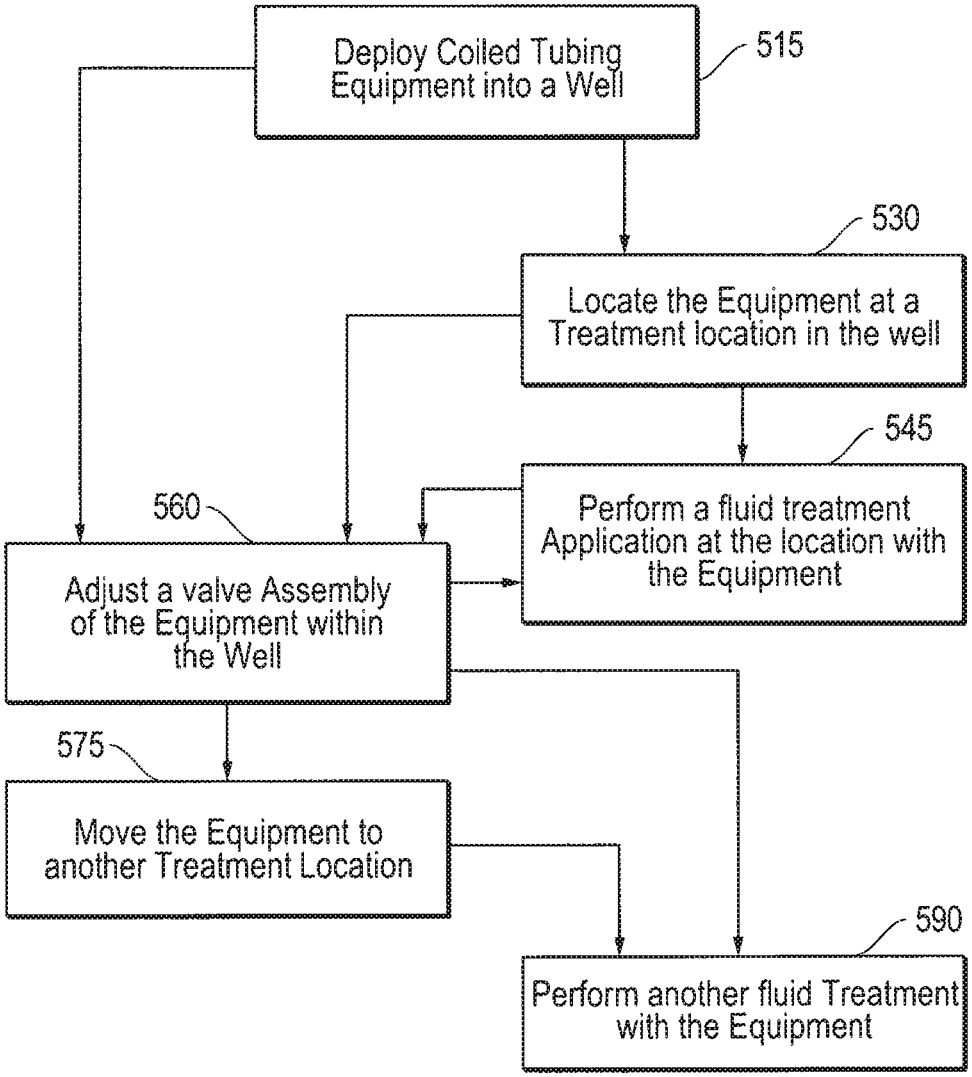
FIG. 5 is a flow-chart summarizing an embodiment of employing a surface controlled reversible coiled tubing valve assembly in a well.

Referring now to FIG. 5, a flow-chart is depicted which summarizes an embodiment of employing a surface controlled reversible coiled tubing valve assembly in a well. Namely, coiled tubing equipment may be deployed into a well and located at a treatment location for performing a treatment application (see 515, 530, 545). Of particular note, as indicated at 560, a valve assembly of the equipment may be adjusted at any point along the way with the equipment remaining in the well. Once more, the equipment may (or may not) be moved to yet another treatment location as indicated at 575 before another fluid treatment application is performed as noted at 590. That is, this subsequent treatment follows adjustment of the valve assembly with the equipment in the well, irrespective of any intervening repositioning of the equipment.

Embodiments described hereinabove include assemblies and techniques that avoid the need for removal of coiled tubing equipment from a well in order to adjust treatment valve settings. Further, valves of the equipment may be employed or adjusted downhole without reliance on the use of any particular flow rates through the coiled tubing. As a result, trips in the well, as well as overall operation expenses may be substantially reduced where various fluid treatment applications are involved.

The preceding description has been presented with reference to the disclosed embodiments. Persons skilled in the art and technology to which these embodiments pertain will appreciate that alterations and changes in the described structures and methods of operation may be practiced without meaningfully departing from the principle, and scope of these embodiments. For example, embodiments depicted herein focus on particular cleanout applications and fiber delivery. However, embodiments of tools and techniques as detailed herein may be employed for alternative applications such as cement placement. Additionally, alternative types of circulation may be employed or additional tools such as isolation packers, multicycle circulation valves. Regardless, the foregoing description should not be read as pertaining to the precise structures described and shown in the accompanying drawings, but rather should be read as consistent with and as support for the following claims, which are to have their fullest and fairest scope.

We claim:

1. A method comprising:

locating coiled tubing equipment at a first treatment location in a well;

performing a downhole application via fluid flow through a valve assembly of the coiled tubing equipment at the first treatment location in the well, wherein the valve assembly comprises a sleeve valve radially disposed within a channel of the valve assembly for adjustably regulating the fluid flow through a radial port of the valve assembly;

moving the coiled tubing equipment to a second treatment location in the well;

after moving the coiled tubing equipment to the second treatment location in the well, adjusting the valve assembly with the coiled tubing equipment in the well to affect the fluid flow to perform at least another downhole application, wherein the adjusting comprises sending communication over a telemetric line to the valve assembly from surface equipment disposed at an oilfield accommodating the well; and powering the valve assembly via an electronics and power housing coupled to the valve assembly and the coiled tubing equipment.

2. The method of claim 1, wherein at least one of the applications is selected from a group consisting of a cleanout application, a fiber delivery application, a multilateral leg locating application, and cement placement.

3. The method of claim 1, comprising governing the regulating of the fluid flow through the radial port of the valve assembly using the telemetric line.

4. The method of claim 3, wherein the telemetric line is of a fiber optic configuration.

5. The method of claim 3, comprising:

governing a first passage using a first sleeve valve; and governing a second passage using a second sleeve valve;

wherein the first and second passages are configured to be independently opened as directed by communications over the telemetric line.

6. The method of claim 3, comprising regulating the fluid flow using an actuating element coupled to the sleeve valve, wherein the actuating element is coupled to the telemetric line via the electronics and power housing.

7. The method of claim 6, wherein the actuating element comprises one of a downhole pump, a downhole motor, a piezo-electric stack, a magnetostrictive material, a shape memory material, and a solenoid.

8. The method of claim 1, comprising performing one of a check valve function and a backpressure valve function using the valve assembly.

9. The method of claim 1, wherein the electronics and power housing comprises a battery for powering the valve assembly.

10. The method of claim 1, wherein the fluid flow is employed by a hydraulic tool coupled to the valve assembly.

11. The method of claim 10, wherein the hydraulic tool comprises one of a cleanout tool and a locating tool.

12. The method of claim 11, wherein the locating tool comprises a pressure pulse communication tool.

13. The method of claim 11, wherein the cleanout tool comprises a jetting tool.

14. The method of claim 1, wherein the fluid flow comprises an acid fluid flow.

* * * * *